US009580882B2

(12) United States Patent
Mulderij

(10) Patent No.: US 9,580,882 B2
(45) Date of Patent: Feb. 28, 2017

(54) PILE UPENDING DEVICE

(71) Applicant: IHC HOLLAND IE B.V., Sliedrecht (NL)

(72) Inventor: Klaas-Jan Mulderij, Delfgauw (NL)

(73) Assignee: IHC Holland IE B.V., Sliedrecht (NL)

( * ) Notice: Subject to any disclaimer, the term of this patent is extended or adjusted under 35 U.S.C. 154(b) by 0 days.

(21) Appl. No.: 14/647,955

(22) PCT Filed: Nov. 29, 2013

(86) PCT No.: PCT/NL2013/050862
§ 371 (c)(1),
(2) Date: May 28, 2015

(87) PCT Pub. No.: WO2014/084738
PCT Pub. Date: Jun. 5, 2014

(65) Prior Publication Data

US 2015/0308069 A1 Oct. 29, 2015

(30) Foreign Application Priority Data

Nov. 29, 2012 (NL) ..... 2009903

(51) Int. Cl.
*E02D 35/00* (2006.01)
*B66C 1/56* (2006.01)
(Continued)

(52) U.S. Cl.
CPC ..... *E02D 35/00* (2013.01); *B66C 1/56* (2013.01); *E02D 11/00* (2013.01); *E02D 13/04* (2013.01); *E04H 12/345* (2013.01)

(58) Field of Classification Search
CPC .... B66C 1/54; B66C 1/56; B66C 1/42; B66C 1/46; E02D 11/00; E02D 13/04; E02D 13/00; E02D 35/00; E04H 12/345
(Continued)

(56) References Cited

U.S. PATENT DOCUMENTS 2,844,404 A * 7/1958 Haugh ..... B66C 1/10 248/324
1,235,469 A 11/1980 Denny et al.
(Continued)

FOREIGN PATENT DOCUMENTS

GB 2224481 5/1990
GB 2265650 10/1993
(Continued)

OTHER PUBLICATIONS

International Search Report dated Mar. 5, 2014, corresponding to PCT/NL2013/050862.
(Continued)

*Primary Examiner* — John Kreck
*Assistant Examiner* — Carib Oquendo
(74) *Attorney, Agent, or Firm* — NLO N.V.; Catherine A. Shultz; Minerva Rivero

(57) ABSTRACT

A pile upending device for large diameter tubular elements includes;

an annular base ring for extending along substantially the entire circumference of the tubular element, a central lifting arm for coupling the pile upending device to a hoisting element, which lifting arm is hingeably coupled with the base ring, a number of wedge assemblies disposed along the outside circumference of the base ring for facing the inside surface of the tubular element and frictional engagement with the tubular element.

15 Claims, 4 Drawing Sheets

(51) Int. Cl.

| | |
|---|---|
| ***E02D 11/00*** | (2006.01) |
| ***E02D 13/04*** | (2006.01) |
| ***E04H 12/34*** | (2006.01) |

(58) Field of Classification Search
USPC ..... 294/67.5, 96; 414/23, 776, 779, 783
See application file for complete search history.

(56) References Cited

U.S. PATENT DOCUMENTS

| | | | | |
|---|---|---|---|---|
| 4,320,915 | A | 3/1982 | Abbott et al. | |
| 4,773,689 | A * | 9/1988 | Wolters | E21B 19/07 294/195 |
| 2011/0011325 | A1 | 1/2011 | Johnson, III et al. | |
| 2011/0109109 | A1 | 5/2011 | Slack | |
| 2011/0290091 | A1* | 12/2011 | Clark, II | E02D 9/005 83/54 |

FOREIGN PATENT DOCUMENTS

| | | |
|---|---|---|
| GB | 2486200 | 6/2012 |
| JP | 2002-309579 | 10/2002 |
| NL | 8301056 | 10/1984 |
| WO | 2010/006445 | 1/2010 |

OTHER PUBLICATIONS

IHC Merwede; "Upending Tool 600t"; IHC Handling Systems V.O.F.

"Balltec LiftLOk Internal Lifting Tool," available at url: https://www.youtube.com/watch?v=GrruLA8aEpk.

"Pipe Handling Internal Lifting Tools," available at url: https://www.youtube.com/watch?v=CjQnacFYrVw.

"Subsea pile driving and handling" available at url: https://www.youtube.com/watch?v=Ohv0JUyx3dc.

Xiao et al., "Feasibility of Chinese offshore market: final thesis," 2004 Bachelor thesis.

* cited by examiner

PILE UPENDING DEVICE

BACKGROUND

The present invention relates to a pile upending device for large diameter tubular elements.

GB2486200 (A) relates to an apparatus for handling tubular members for use in offshore anchoring systems. GB2486200 describes, there is a trend towards the use of larger tubular metal piles in offshore anchoring systems, especially for offshore wind turbine installations. As pile size increases the ratio of diameter to wall thickness usually also increases. This leads to greater flexibility of the pile and a consequent need for more careful handling as damage to the pile is to be avoided. It is an object of GB2486200 to provide improved apparatus for handling tubular members. Therefore, there is provided an apparatus for handling tubular members comprising at least one gripping head, the gripping head comprising a pair of rollers and means for urging the rollers towards each other to grip a wall of the tubular member. Use of rollers to grip the wall of a tubular member reduces the risk of damaging the wall as compared to solid gripping elements.

There is room for improvement in connection with pile upending device for large diameter tubular elements in that load to the pile, specifically the wall thereof, is reduced.

SUMMARY OF THE INVENTION

The invention aims to provide a pile upending device for large diameter tubular elements wherein the load to the pile, specifically the wall thereof, is reduced. Another object of the invention is to improve a known pile upending device for large diameter tubular elements in that a problem associated therewith is partly solved. Yet another object of the invention is to provide an alternative pile upending device for large diameter tubular elements.

According to a first aspect of the invention this is realized with a pile upending device for large diameter tubular elements, the device comprising;

- an annular base ring for extending along substantially the entire circumference of the tubular element,
- a central lifting arm for coupling the pile upending device to a hoisting element, which lifting arm is hingeably coupled with the base ring,
- a number of wedge assemblies disposed along the outside circumference of the base ring for facing the inside surface of the tubular element and frictional engagement with the tubular element.

The annular base ring is preferably centrally open which enables the central arrangement of the lifting arm and reduces weight of the upending device. The lifting arm being hingeably coupled with the base ring enables reduction of bending moments between the pile upending device and the tubular element during upending because the lifting arm being hingeable enables to align the hoisting point with the contact area between the pile upending device and the tubular element. Aligning the hoisting point with the contact area means that the hoisting force is aligned with the contact area. The number of wedge assemblies provide an even engagement of the tubular element and avoid load concentration.

Large diameter here means tubular elements for use in offshore anchoring systems, the diameter of such a tubular element being e.g. between 3 and 7 meter. It is noted that the present invention does not relate to conductor strings which typically have smaller diameters like 1 meter or less.

In an embodiment of the pile upending device, the diameter of the outside circumference of the base ring exceeds 3 meters, preferably exceeds 4 meter, more preferably is between 4 and 7 meter.

In an embodiment of the pile upending device, the number of wedge assemblies extend in total over more than 50% of the outside circumference of the base ring. This even more provides an even engagement of the tubular element and avoid load concentration.

In an embodiment of the pile upending device, the lifting arm is hingeable around a lifting arm rotation axis, and the rotation axis extends in a plane which is defined by the number of wedge assemblies such that in use the rotation axis imaginary crosses an annular contact area between the pile upending device and the tubular element. This even more enables reduction of bending moments between the pile upending device and the tubular element during upending.

In an embodiment of the pile upending device, the rotation axis extends through the centre of the base ring. This centres the hoisting force with respect to the pipe upending device and even more enables reduction of bending moments between the pile upending device and the tubular element during upending.

In an embodiment, the pile upending device, comprises a lifting arm driving device for angular displacement of the lifting arm with respect to the base ring. This even more enables to control or reduce the bending moment on the tubular element. In addition, this facilitates handling of the pile upending device and in particular inserting the pile upending device into the tubular element.

In an embodiment, the pile upending device comprises a base ring driving device for centring the base ring with respect to the tubular element.

In an embodiment of the pile upending device, the base ring driving device comprises a number of drive units for contacting the inside surface of the tubular element.

In an embodiment of the pile upending device, a wedge assembly, preferably each wedge assembly, of the number of wedge assemblies, comprises a wedge driving device.

In an embodiment of the pile upending, the wedge assembly, of the number of wedge assemblies, comprises a wedge surface which is moveably arranged and moveable between a wedge inner position wherein the pile upending device can be introduced or taken out of a tubular element, and a wedge outer position wherein the wedge surface contacts the tubular element for friction coupling between the pile upending device and the tubular element.

In an embodiment of the pile upending, the wedge surface is moveable over a relative long stroke.

The invention further relates to an assembly of a tubular element and a pile upending device according to the invention, which pile upending device is friction coupled with the tubular element.

In an embodiment of the assembly, the pile upending device is friction coupled with a conical section of the tubular element.

The invention further relates to a method for upending a large diameter tubular element, comprising the steps;

- providing a pile upending device according to a preceding claim,
- introducing the device in a top end of a horizontal tubular element while controlling the angular position of the base ring with respect to the lifting arm,
- centring the pile upending device with respect to the tubular element, extending the wedge assemblies for frictional engagement with the tubular element, upending the tubular element at a lift point on the lifting arm, lifting the tubular element.

The invention further relates to a device comprising one or more of the characterising features described in the description and/or shown in the attached drawings.

The invention further relates to a method comprising one or more of the characterising features described in the description and/or shown in the attached drawings.

The various aspects discussed in this patent can be combined in order to provide additional advantageous advantages.

DESCRIPTION OF THE DRAWINGS

The invention will be further elucidated referring to a preferred embodiment of a pile upending device according to the invention shown in the drawing wherein shown in.

DETAILED DESCRIPTION OF EMBODIMENTS

Figure 1:
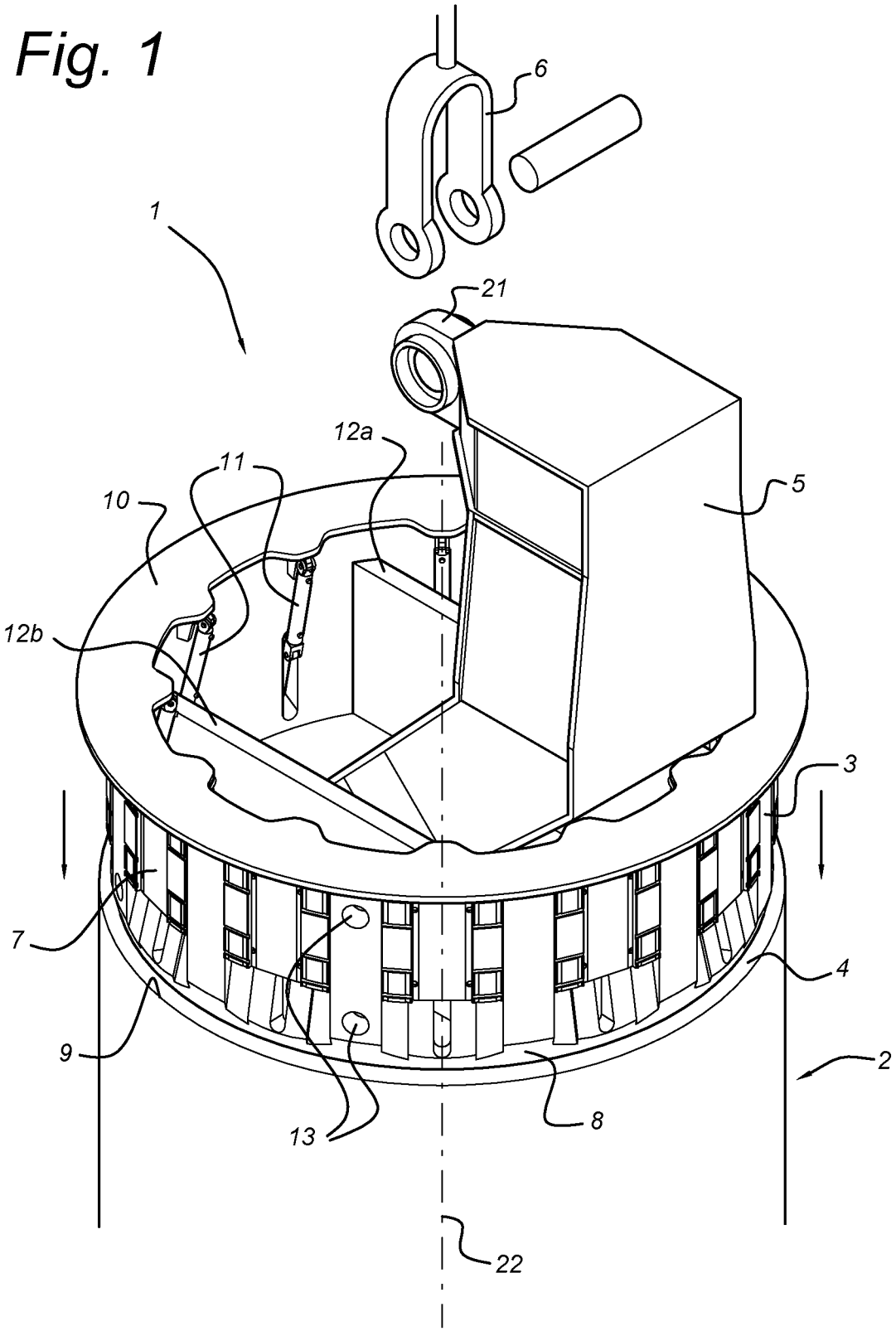
FIG. 1 in perspective view a pile upending device according to the invention.

FIG. 1 shows in perspective view a pile upending device 1. The pile upending device 1 is suitable for handling, in particular upending, large diameter tubular elements 2. The pile upending device 1 comprises an annular base ring 3. The shown base ring 3 is substantially centrally open. The base ring 3 extends along the entire circumference 4 of the tubular element 2. The diameter of the outside circumference of the base ring 3 exceeds 3 meters, preferably exceeds 4 meter, more preferably is between 4 and 7 meter.

The pile upending device 1 comprises a central lifting arm 5. The central lifting arm 5 is suitable for coupling the pile upending device 1 via a lift point 21 to a hoisting element 6. The lifting arm 5 is suitable to transfer forces required for upending and lifting the pile, here the tubular element 2 which may easily weigh up to one thousand tons and more. The lifting arm is 5 is hingeably coupled with the base ring 3. The forces required for upending and lifting the tubular element 2 are transferred through the base ring 3 onto the tubular element 2.

The pile upending device 1 comprises a number of wedge assemblies 7 suitable for frictional engagement with the tubular element 2, specifically the wall thereof. The wedge assemblies 7 are evenly disposed along the outside circumference 8 of the base ring 3 for even distribution of forces. Other arrangements of the wedge assemblies 7 are conceivable. The wedge assemblies 7 face radial outwards from the base ring 3 such that in use the wedge assemblies 7 face the inside surface 9 of the tubular element 2. The number of wedge assemblies 7 extend in total over more than 50%, here about 70%, of the outside circumference of the base ring 3.

FIG. 1 shows the pile upending device 1 above the tubular element 2 shortly before engaging the tubular element 2 to form an assembly of the tubular element 2 and the pile upending device 1 wherein the pile upending device 1 is friction coupled with the tubular element 2. The central axis of the base ring 3 is about aligned with the longitudinal axis 22 of the tubular element 2.

The pile upending device 1 here engages a cylindrical top section of the tubular element 2. It is however conceivable that the pile upending device 1 engages a conical section (not shown) of the tubular element 2 so that the pile upending device 1 is friction coupled with the conical section of the tubular element 2.

A top plate 10 contributes strength to the pile upending device 1 and, in use, abuts with its lower face the rim 4 of the tubular element 2 for facilitating alignment of the pile upending device 1 and the tubular element.

Figure 2:
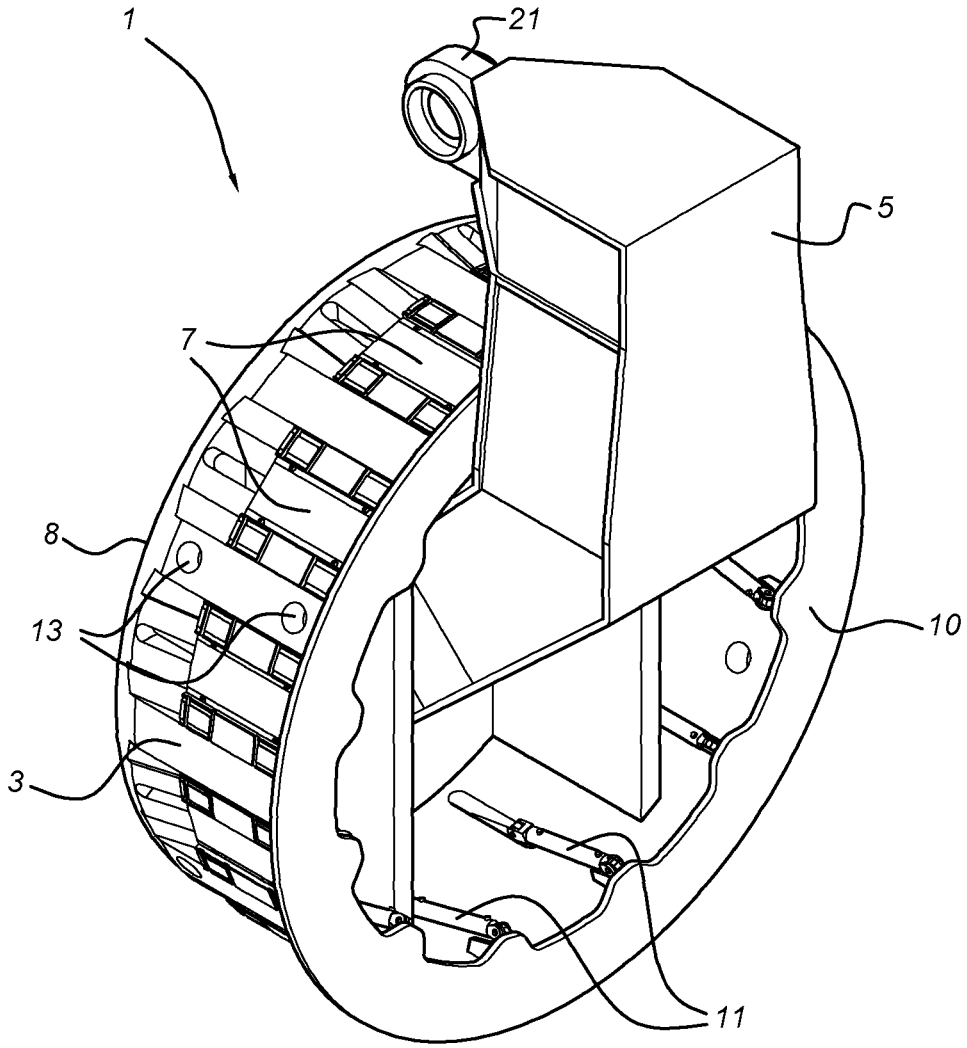
FIG. 2 the pile upending device according to FIG. 1 in a different position.

FIG. 2 shows the pile upending device 1 of FIG. 1 in a different position. The base ring 3 is rotated over about 90° and the central axis of the base ring 3 extends horizontally.

Figure 3:
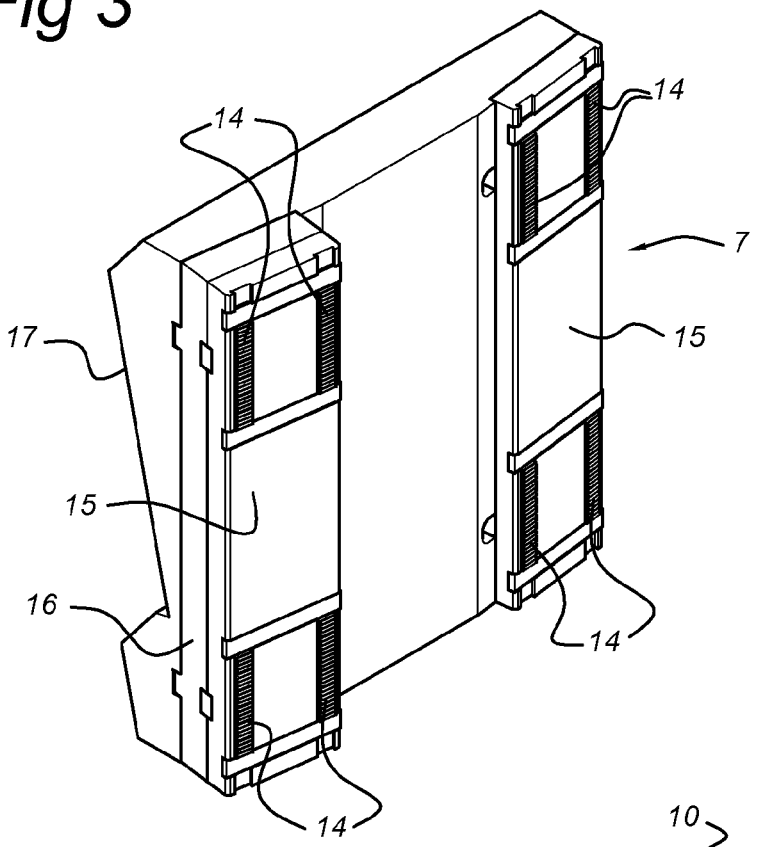
FIG. 3 a detail of a wedge assembly of the pile upending device according to FIG. 1.
Figure 4:
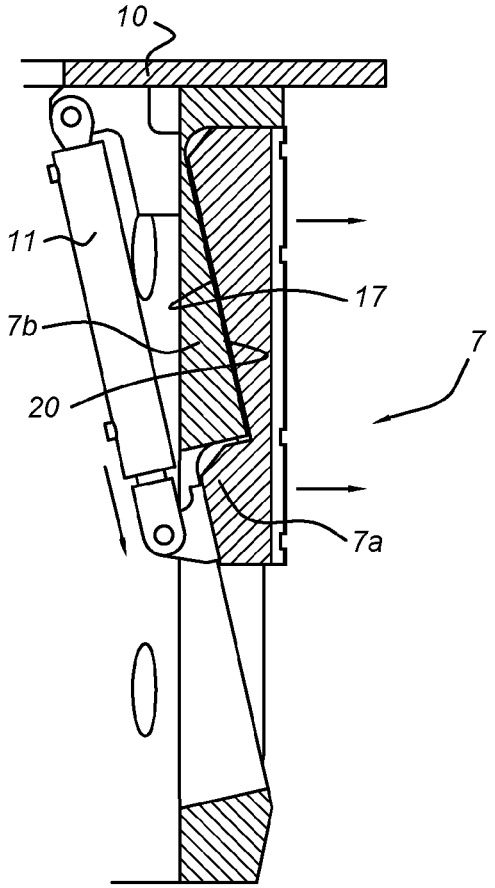
FIG. 4 a cross sectional side view of a wedge assembly of the pile upending device according to FIG. 1.

FIG. 3 shows a detail of the wedge assembly 7 of the pile upending device 1. The moveable wedge section is provided with a number, here two, button plates 15. A button plate 15 has in this case four button rows 14 provided with a series of buttons to provide frictional engagement. The button plates 15 and specifically the button rows thereof form in total, in use, the annular contact area between the pile upending device 1 and the tubular element 2. A spacer 16 is arranged behind a button plate 15 to adjust its radial position to adapt the upending device 1 to a desired diameter. FIG. 4 depicts a cross sectional side view of the wedge assembly 7 of the pile upending device 1. The wedge assembly 7, of the number of wedge assemblies, comprises a wedge surface 17. The wedge assembly moving portion 7*a* is moveably arranged and moveable between a wedge inner position (shown) wherein the pile upending device 1 can be introduced or taken out a tubular element 2, and a wedge outer position (not shown) wherein the wedge surface contacts the tubular element 2 for friction coupling between the pile upending device 1 and the tubular element 2. Preferably, the wedge assembly 7, specifically the wedge assembly moving portion 7*a*, is radially moveable over a relative long stroke, like 10 cm.

The two mating wedge surfaces 17, 20 provide a radial outward movement of the button plates 15 when the wedge driving device, here a hydraulic cylinder 11, is extended. The two mating wedge surfaces 17, 20 also provide the wedge effect once the button plates 15 are in friction coupling with tubular element 2. The wedge surface 20 is part of the wedge assembly stationary portion 7*b* . Here, each wedge assembly 7, of the number of wedge assemblies, comprises a hydraulic cylinder 11.

Figure 5:
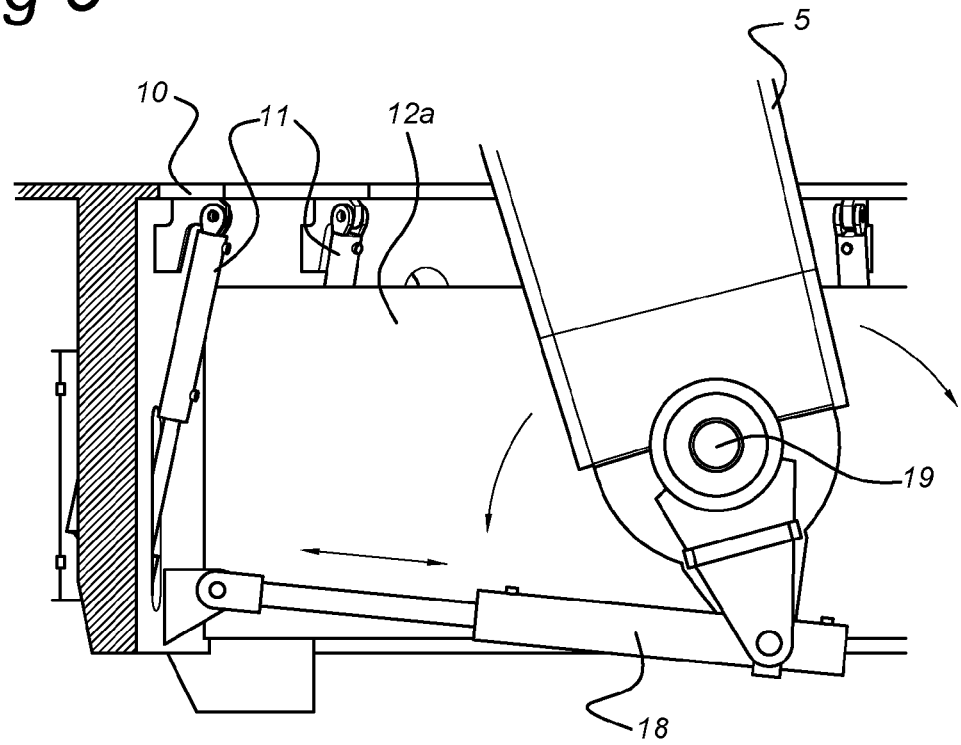
FIG. 5 a side view, partly cross sectional, of the pile upending device according to FIG. 1.

FIG. 5 shows a side view, partly cross sectional, of the pile upending device 1. The pile upending device 1 comprising a lifting arm driving device, here a hydraulic cylinder 18, for angular displacement of the lifting arm 5 with respect to the base ring 3. The lifting arm 5 is rotatably disposed around axis of rotation 19. The lifting arm 5 is disposed between a pair of plate members 12*a*, 12*b* which enforce the base ring 3.

The rotation axis 19 extends in a plane which is defined by the number of wedge assemblies 7 such that in use the rotation axis 19 imaginary crosses the annular contact area between the pile upending device 1 and the tubular element 2. As shown, the rotation axis 19 extends through the centre of the base ring 3.

Figure 6:
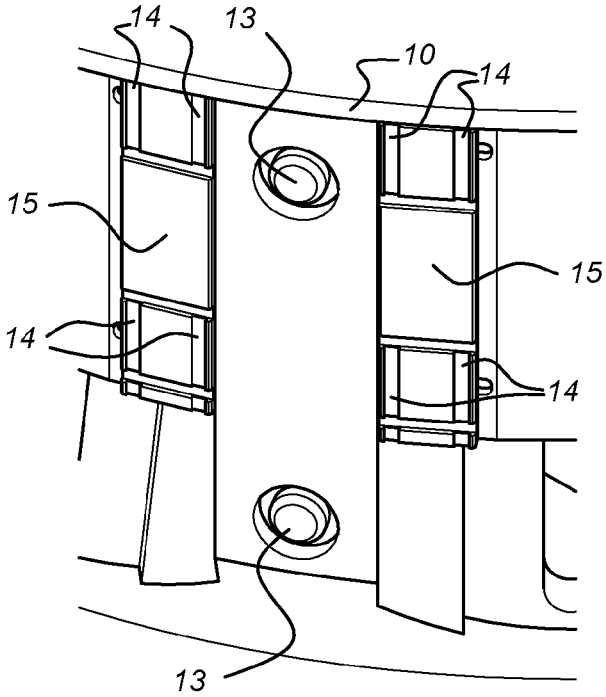
FIG. 6 a detail of base ring driving device of the pile upending device according to FIG. 1.

FIG. 6 shows a detail of a base ring driving device 13 of the pile upending device. The base ring driving device 1 is suitable for centring the base ring 3 with respect to the tubular element 2 prior to friction coupling the pile upending device 1 with the tubular element 2. The base ring driving device 13 comprises a number of drive units for contacting the inside surface 9 of the tubular element 2.

During use of the pile upending device 1 following method for upending a large diameter tubular element 2 can be executed. The method comprising the steps;

providing a pile upending device 1, introducing the device 1 in a top end of a horizontal tubular element 2 while controlling the angular position of the base ring 3 with respect to the lifting arm 5, centring the pile upending device 1 with respect to the tubular element 2, extending the wedge assemblies 7 for frictional engagement with the tubular element 2, upending the tubular element 2 at a lift point 21 on the lifting arm 5, lifting the tubular element 2.

It will also be obvious after the above description and drawings are included to illustrate some embodiments of the invention, and not to limit the scope of protection. Starting from this disclosure, many more embodiments will be evident to a skilled person which are within the scope of protection and the essence of this invention and which are obvious combinations of prior art techniques and the disclosure of this patent.

The invention claimed is:

1. A pile upending device for large diameter tubular elements, the device comprising;

an annular base ring for extending along the entire circumference of the tubular element, a central lifting arm for coupling the pile upending device to a hoisting element, which lifting arm is hingeably coupled with the base ring, a number of wedge assemblies disposed along an outside circumference of the base ring for facing an inside surface of the tubular element and frictional engagement with the tubular element, wherein the central lifting arm is moveably disposed between a pair of plate members within the annular base ring.

2. The pile upending device according to claim 1, wherein the diameter of the outside circumference of the base ring exceeds 3 meters.

3. The pile upending device according to claim 1, wherein the base ring is centrally open.

4. The pile upending device according to claim 1, wherein the number of wedge assemblies extend in total over more than 50% of the outside circumference of the base ring.

5. The pile upending device according to claim 1, wherein the lifting arm is hingeable around lifting arm rotation axis, and the rotation axis extends in a plane which is defined by the number of wedge assemblies such that in use the rotation axis imaginary crosses an annular contact area between the pile upending device and the tubular element.

6. The pile upending device according to claim 5, wherein the rotation axis extends through the centre of the base ring.

7. The pile upending device according to claim 1, comprising a lifting arm driving device for angular displacement of the lifting arm with respect to the base ring.

8. The pile upending device according to claim 1, comprising a base ring driving device for centring the base ring with respect to the tubular element.

9. The pile upending device according to claim 8, wherein the base ring driving device comprises a number of drive units for contacting the inside surface of the tubular element.

10. The pile upending device according to claim 1, wherein a wedge assembly of the number of wedge assemblies, comprises a wedge driving device.

11. The pile upending device according to claim 1, wherein a wedge assembly, of the number of wedge assemblies, comprises a wedge surface which is moveably arranged and moveable between a wedge inner position wherein the pile upending device can be introduced or taken out of the tubular element, and a wedge outer position wherein the wedge surface contacts the tubular element for friction coupling between the pile upending device and the tubular element.

12. The pile upending device according to claim 11, wherein the wedge surface is moveable over a long stroke.

13. An assembly of a tubular element and a pile upending device according to claim 1, wherein the pile upending device is friction coupled with the tubular element.

14. An assembly according to claim 13, wherein the pile upending device is friction coupled with a conical section of the tubular element.

15. A method for upending a large diameter tubular element, comprising the steps;

providing a pile upending device according to claim 1, introducing the device in a top end of a horizontal tubular element while controlling an angular position of the base ring with respect to the lifting arm, centring the pile upending device with respect to the tubular element, extending the wedge assemblies for frictional engagement with the tubular element, upending the tubular element at a lift point on the lifting arm, and lifting the tubular element.

* * * * *